United States Patent [19]

Robinson

[11] 4,063,484

[45] Dec. 20, 1977

[54] METHOD AND APPARATUS FOR GENERATING TONE SIGNALS FOR A MUSICAL INSTRUMENT

[75] Inventor: John William Robinson, Jasper, Ind.

[73] Assignee: Kimball International, Inc., Jasper, Ind.

[21] Appl. No.: 623,784

[22] Filed: Oct. 20, 1975

[51] Int. Cl.[2] ..... G10H 1/02

[52] U.S. Cl. ..... 84/1.24; 84/1.01

[58] Field of Search ..... 84/1.01, 1.03, 1.11, 84/1.23, 1.24, DIG. 4, DIG. 11

[56] References Cited

U.S. PATENT DOCUMENTS

| | | | |
|---|---|---|---|
| 3,253,078 | 5/1966 | Wolfonger | 84/DIG. 4 |
| 3,355,539 | 11/1967 | Munch | 84/1.23 |
| 3,499,090 | 3/1970 | Meter | 84/1.01 |
| 3,601,518 | 10/1969 | Hill | 84/DIG. 11 |
| 3,702,370 | 11/1972 | Hallman, Jr. | 84/1.11 |
| 3,790,693 | 2/1974 | Adachi | 84/1.01 |
| 3,800,060 | 3/1974 | Hallman, Jr. | 84/1.24 |
| 3,816,635 | 6/1974 | Vetrecht | 84/1.01 |
| 3,828,109 | 8/1974 | Morez | 84/1.01 |
| 3,842,702 | 10/1974 | Tsundoo | 84/DIG. 11 |
| 3,956,961 | 5/1976 | Peterson | 84/1.24 |

*Primary Examiner*—Robert K. Schaefer
*Assistant Examiner*—Vit W. Miska
*Attorney, Agent, or Firm*—Albert L. Jeffers; John F. Hoffman

[57] ABSTRACT

A method and apparatus for generating tone signals for a musical instrument, especially an electronic organ, in which a stable high frequency source which is equal in frequency to that of a reference pitch multiplied by a large whole number is divided down by a number differing a predetermined amount from the large whole number, and the thus divided down frequency is supplied to a phase lock loop which, in turn, supplies a synthesizer which will develop a range of pitches over a musical scale. By further dividing down the synthesized pitches, octavely related pitches can be obtained for the supply of pitches in conformity with the number of playing keys in the instrument and the number of ranks of pitches desired. The thus generated pitches differ slightly from the reference pitches by being either somewhat sharp or somewhat flat and when combined with the reference pitches produce desired effects.

18 Claims, 5 Drawing Figures

METHOD AND APPARATUS FOR GENERATING TONE SIGNALS FOR A MUSICAL INSTRUMENT

The present invention relates to a method and apparatus for generating tone signals for a musical instrument, especially an electronic organ, and is concerned, in particular, with a method and apparatus for developing pitches which deviate slightly in frequency from reference pitches.

In a conventional electronic organ, basic pitches are generated in conformity with the equal tempered scale. The basic pitches, which may be referred to as reference pitches, might be derived, for example, from a top octave synthesizer which produces the pitches corresponding to the highest octave in the shortest footage rank desired with these pitches then being divided down by multiples of two to provide octavely related pitches extending down to the lowest keys of the instrument and the greatest footage rank to be played.

The generation of pitches in the aforesaid manner results in a range of frequencies that correspond with one another in exact ratios of two to one in going from one octave to another. The tone signals, usually in the form of square waves, can be modified in voice circuits to change the timber thereof thereby to simulate the sounds of various instruments or to produce other sounds that might be desired.

However, with all of the pitches related in the aforesaid manner, it is not possible to simulate the conditions that arise when a plurality of individual instruments are being played at the same time in an orchestral group. In short, no ensemble effect is possible when the pitches of one octave are related to those in another octave in the aforesaid simple manner.

Ensemble effects can be obtained by utilizing slightly de-tuned pitches, namely, pitches that are somewhat sharp or somewhat flat, especially in combination with normal pitches in order to produce ensemble effects, which effects are based primarily on beating of two frequencies together and which beating might occur at a high rate of speed.

With the foregoing in mind, an object of the present invention is the provision of a method and apparatus for generating tone signals and which method and apparatus makes available normal tone signals as well as detuned tone signals.

A further object is the provision of a method and apparatus for producing tone signals, including detuned signals, and the mixing thereof to provide signal sources for various instrument types and for various effects that might be desired.

BRIEF SUMMARY OF THE INVENTION

According to the present invention, a reference pitch is selected, say, a high C at a frequency of 2093.003 hertz. A stable high frequency oscillator is provided which supplies signals at a frequency which is equal to the frequency of the reference pitch multiplied by a large whole number, say, 1,000. IN this particular case, the stable oscillator would run at a speed of 2.093003 megahertz.

The output from the high frequency source is supplied to a variable, or adjustable, frequency divider and is divided down by a number differing from the aforementioned large whole number by a fractional amount. For example, the division ratio may range from, say, 990 to 1010.

The output from the adjustable frequency divider forms one input to a phase detector, the output of which drives a voltage controlled oscillator with the output of the voltage controlled oscillator forming the input to a synthesizer which produces a range of pitches corresponding to the highest octave of pitches to be played, or pitches which are double in frequency to the highest range of pitches to be played.

When the synthesizer supplies the double frequency pitches, each pitch is divided by two to produce the highest octave of pitches to be played. Further divisions of the pitches will produce the other octaves which are needed for the entire range of pitches to be played.

Due to the division ratio which is slightly different from the aforementioned large whole number, the output from the synthesizer corresponding to the reference pitch will slightly de-tuned therefrom and when fed back to the other input of the phase detector, will establish a phase lock which will lock the input to the synthesizer at exactly the right amount to maintain the amount of de-tuning which corresponds to the division ratio.

When the division ratio is, for example, 990, the pitch corresponding to the reference pitch of high C is about 18 per cent sharp. When the division ratio is, on the other hand, 1010, the pitch corresponding to the reference pitch high C is about 17 per cent flat. Other division ratios falling between 990 to 1010 provide different degrees of deviation from true pitch. If the division ratio is selected at 1,000, the pitch from the synthesizer if fed back as the second input to the voltage control oscillator is, of course, at the reference frequency of high C.

At this point, it will be appreciated that pitches can be developed which are normal or which are sharp or which are flat with the sharped and flatted pitches being variable as to the amount of deviation from true pitch.

By combining the true pitches with the divided pitches, ensemble effects can readily be created in a fairly simple manner. Thus, instruments, such as reeds, which have true pitch, can be supplied from a generator producing normal pitch frequencies. Other instruments, such as strings, which are usually played in an orchestra in groups, can be supplied with normal pitches, sharp pitches and flat pitches.

Flute tones can also be supplied with normal, sharp and flat pitches.

Certain other effects, such as celeste, can be obtained by the supply of strongly flatted tones.

Still other effects will occur to those skilled in the art.

It is possible, in any case, to provide such overall effects as vibrato and glide by controlling, for example, the stable high frequency oscillator. Vibrato, for example, involves varying the high frequency oscillator at a frequency of about 6 ½ hertz and the depth of the vibrato can be controlled by controlling the amount of variation of the high frequency oscillator.

Other effects, like the simulation of a Hawaiian guitar, can be obtained by sudden change of a high frequency oscillator accompanied by a gradual restoration of the oscillator to rated frequency.

A further effect, referred to as razz, is obtained in the same way as the vibrato except the frequency with which the oscillator is varied is much higher.

Other known type means can be employed for obtaining these effects on single ones of the generated groups of pitches according to individual preference.

The exact nature of the invention will become more clearly apparent upon reference to the following detailed specification taken in connection with the accompanying drawings in which.

Figure 1:
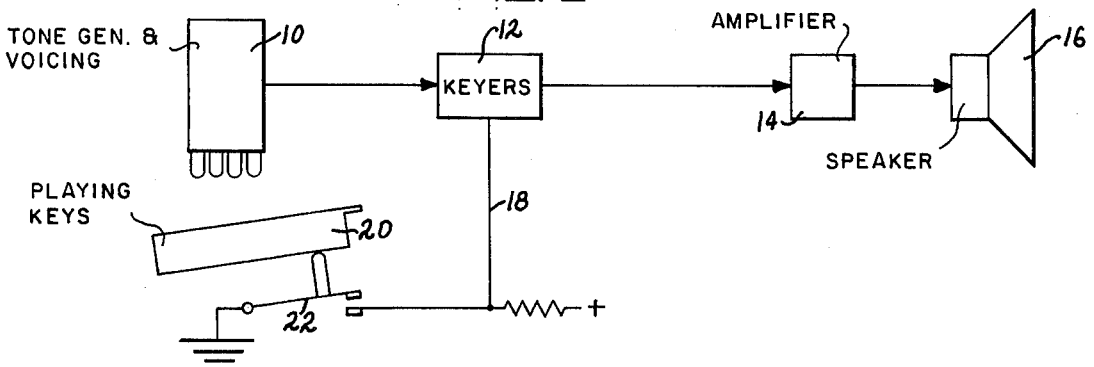
FIG. 1 is an extremely schematic view showing how tone signals are routed from a tone generator through keyers to an amplifier and speaker system while the keyers of the system are under the control of the playing keys of the organ.

DETAILED DESCRIPTION OF THE INVENTION:

Referring to the drawings somewhat more in detail, in FIG. 1, 10 schematically indicates tone generating and voicing means. The tone signals, and which are electric signals within the range of audible frequencies, are supplied to keyers 12 and from which the signals are supplied to amplifier means 14 and from the amplifier means to speaker means 16.

Each keyer 12, of which only one is illustrated in FIG. 1, has a control terminal to which a signal wire 18 is connected with the signal wire 18 adapted for being connected to a signal source by the depression of a respective playing key 20 which actuates switch 22 that is connected to wire 18. In the illustrated arrangement, keyer 12 is normally biased to nonconduction by a positive voltage source and goes to conduction when switch 20 is closed and grounds wire 18.

Figure 2:
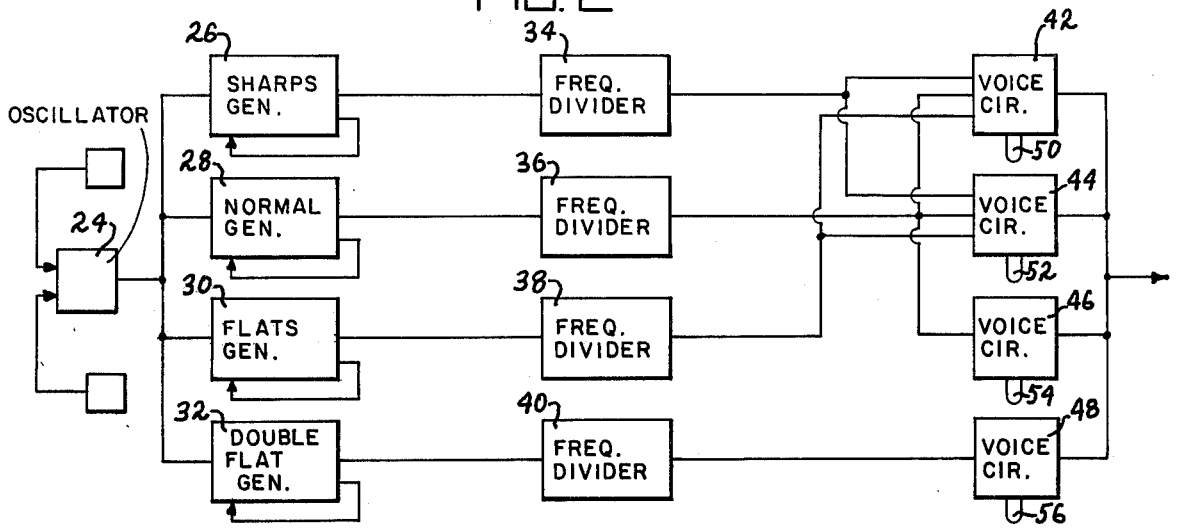
FIG. 2 is a schematic diagram showing the tone generator arrangement of FIG. 1 in more detail.

FIG. 2 shows somewhat more in detail the tone generator and voicing means 10 of FIG. 1. In FIG. 2, a stable high frequency oscillator 24 is provided and the output of which is connected to the inputs of the sharp generator 26, the normal generator 28, the flat generator 30, and the double flat generator 32. Each generator is followed by a respective frequency divider 34, 36, 38 and 40, the outputs of which supply a complete range of pitches of the organ.

A plurality of voice circuits 42, 44, 46 and 48 are provided, each of which has associated therewith a respective control tab 50, 52, 54 and 56.

The outputs from the voice circuits are interconnected and form the input to the aforementioned amplifier 14.

At this point, it will be seen that elements 26, 34 and 42, for example, make up a main portion of generator 10, while the other parts of FIG. 2 are similarly included within the showing at 10 in FIG. 1.

Figure 3:
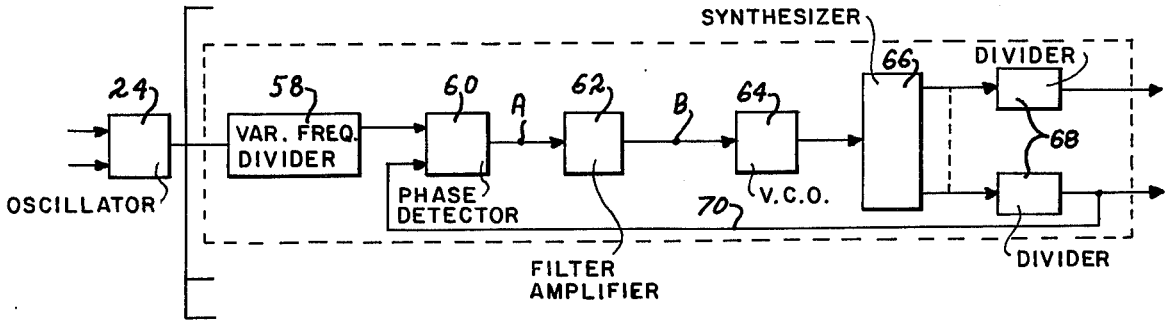
FIG. 3 is a fragmentary view showing more in detail the construction of one of the generators of FIG. 2.

Each of the generator branches in FIG. 2, namely, what has been referred to, for example, as the sharps generator 26, is shown in detail in FIG. 3. In FIG. 3, it will be seen that the component at 26, which has been referred to as the sharps generator, comprises a variable or adjustable frequency divider 58 supplied by high frequency oscillator 24. This frequency divider, in the case of generator 26, may divide the frequency from oscillator 24 by, say, 990. The frequency of oscillator 24 is preferably 2.093003 megahertz representing exactly 1,000 times the frequency of a high C note.

The output from adjustable voltage divider 58 is supplied as one input to a phase detector 60, the output of which is supplied through a filteramplifier 62 to the input side of a voltage controlled oscillator 64. The output side of voltage controlled oscillator 64 forms the input to a synthesizer 66 having a plurality of outputs.

The frequencies at the outputs of synthesizer 66 may correspond, for example, to about twice the frequency of the highest octave of pitches to be played by the organ although this is merely an exemplary relation. The outputs from synthesizer 66 are supplied to the inputs of the divide by two frequency divider 68 so that the outputs of divider 68 correspond about to the frequency of the top octave to be played while being slightly sharp.

The output from the one of frequency dividers 68 which corresponds most nearly to high C is connected back by wire 70 to the other input of phase detector 60 so that a phase lock loop is formed which holds the frequency at the output side of the aforementioned frequency divider 68 at exactly 2.093003 megahertz divided by 990 and which is equal to a frequency of 2114.144 hertz and which is about one per cent sharp with reference to the reference high C frequency of 2093.003 hertz.

Figure 4:
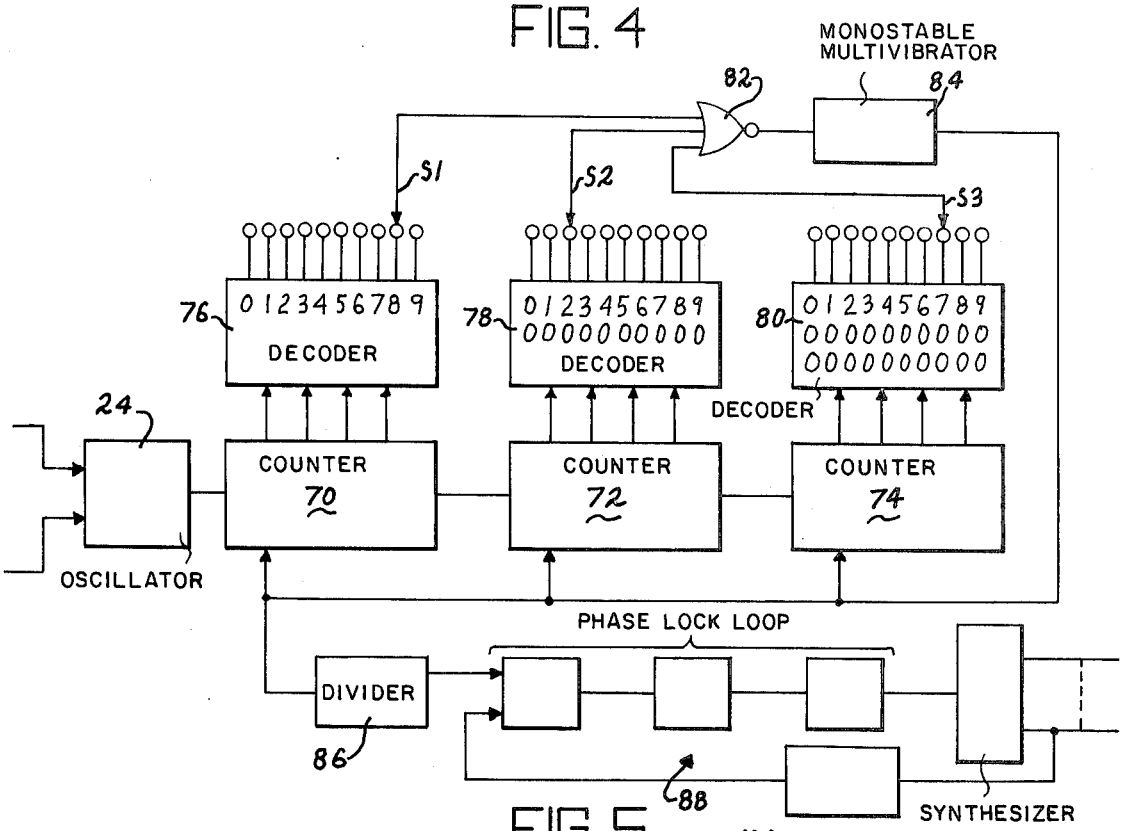
FIG. 4 shows more in detail one form which the variable or adjustable divider and a control system operated thereby can take.

FIG. 4 shows a particular arrangement of a dividing structure in which the stable high frequency oscillator 24 supplies decade counters 70, 72 and 74. The outputs of the counters are connected to respective decoders 76, 78 and 80, each having ten outputs representing decimal numbers.

For example, decoder 76 has outputs running from 0 to 9, decoder 78 has outputs running from 00 to 90 and decoder 80 has outputs running from 000 to 900. Selective connections are made with the outputs of the decoders by means of switches S1, S2 and S3. As illustrated, S1 is on 8, S2 is on 20 and S3 is on 700. On count 728, the switches, through NOR gate 82, pulses a monostable multivibrator 84 and which pulse is supplied to the reset terminals of decade counters 70, 72 and 74 and to a frequency divider 86 which squares up the pulse and and divides the frequency by two and supplies the output to one input of the phase lock loop generally indicated at 88 and which conforms in configuration to that described for FIG. 3. By adjustment of switches S1, S2 and S3, any predetermined division ratio of the output of high frequency oscillator 24 can be achieved.

Figure 5:
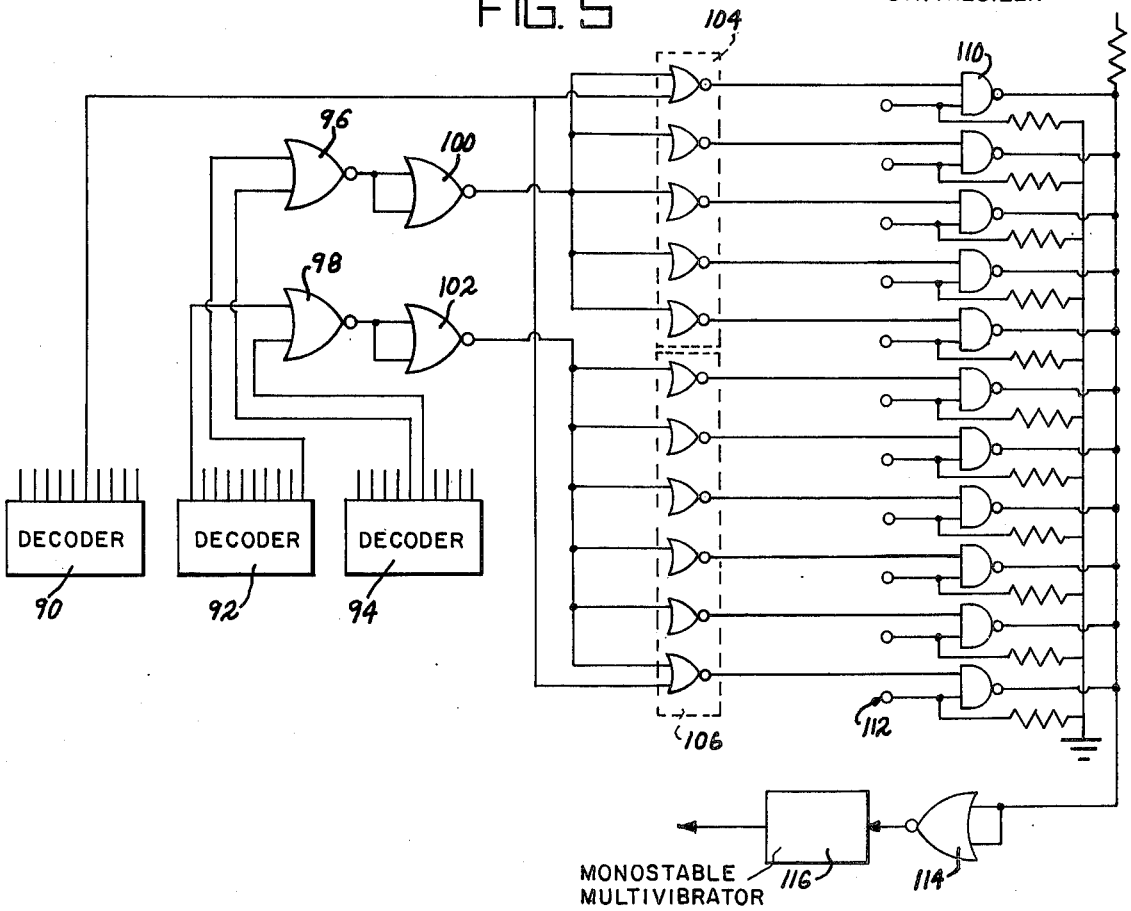
FIG. 5 is a view somewhat like FIG. 4 but shows more in detail the manner in which pitches are generated and routed.

FIG. 5 shows a somewhat more sophisticated arrangement in which the decimal decoders 90, 92 and 94 each of which has ten output terminals the same as in connection with decoders 76, 78 and 80 are provided in association with a pair of NOR gates 96 and 98, each of which has two input terminals connected to respective terminals of the decimal decoders. For example, NOR gate 96 has its inputs connected to the 400 and 90 terminals of the decimal decoders whereas NOR gate 98 has the inputs connected to the 500 and 00 terminals of the decimal decoders.

Each of NOR gates 96 and 98 is connected through a further NOR gate 100, 102 with one input of a respective group of gates. For example, the output of NOR gate 100 is connected to one input of each of the NOR gates within rectangle 104 with the other input of each of the NOR gates being connected to a respective one of the 5, 6, 7, 8 and 9 terminals of the decimal decoder 90.

Similarly, the output of NOR gate 102 is connected to one input of each of a group of NOR gates indicated at 106 with the other inputs of the gates connected respectively, to the 0, 1, 2, 3, 4 and 5 terminals of decimal decoder 90.

At this point, it will be seen that the outputs of the gates 104 and 106 will occur on counts 495 through 505, respectively, with the output of each of the NOR gates at 104, 106 connected to one input of a respective NAND gate 110. Each NAND gate 110 has another terminal connected through a resistor to ground and also to a control terminal, the said control terminals generally being indicated at 112.

Each of the NAND gates 110 is enabled by the supply of a "1" to the input connected to the control terminal thereof and upon being actuated supplies a pulse through NOR gate 114 to the input of the monostable multivibrator 116, the output of which, as in connection with FIG. 4, resets the decade counters that are connected to the digital decoders 90, 92 and 94 while, also, supplying a pulse through a frequency divider to one input of a phase lock loop.

The FIG. 5 arrangement is adapted for having the control terminals 112 of the IC control gates 110 electronically addressed and by sweeping these terminals at the vibrato rate of 6 ½ hertz, i.e., by sequentially supplying enabling signals thereto, vibrato can readily be obtained. Other effects as described above are also obtainable by the FIG. 5 arrangement.

Vibrato may also be imparted to the tones generated by injecting a voltage at vibrato frequency at either of the points marked A or B in FIG. 3.

In respect of the particular counters illustrated which, for the sake of convenience, have been illustrated as decade counters, it will be understood that various binary counters, presettable counters, polynomial counters and specially connected shift registers can also be employed in the system.

Modifications may be made within the scope of the appended claims.

What is claimed is:

1. In an electronic organ having keyers adapted when actuated to key tone signals; and means for developing a range of tone frequencies for being keyed by said keyers comprising: a high frequency stable oscillator, a plurality of variable frequency dividers driven by the stable oscillator and each dividing the signal supplied thereto by a respective factor to produce sharp, flat, and normal frequencies at the respective divider outputs, a phase detector having one input connected to the output of each divider, a voltage controlled oscillator having one input connected to the output of each said phase detector, a synthesizer for each detector and having an input, means connecting the input of eacy synthesizer to the output of the respective voltage controlled oscillator, each synthesizer having a plurality of outputs at respective frequencies, means connecting one of the outputs of each synthesizer to the other input of the respective phase detector, voice circuit means having control terminals connected to said keyers, and means for connecting the outputs of said synthesizers in selected groupings thereof to said voice circuits for the supply of tone signals of respective character thereto.

2. An electronic organ according to claim 1 which includes filter means interposed between each said phase detector and the respective voltage controlled oscillator.

3. An electronic organ according to claim 1 in which each said variable frequency counter means comprises decade counter means.

4. In an electronic organ having keyers adapted when actuated to key tone signals; and means for developing a range of tone frequencies for being keyed by said keyers comprising: a high frequency stable oscillator, a plurality of varible frequency dividers driven by the stable oscillator and each dividing the signal supplied thereto by a respective factor, a phase detector having one input connected to the output of each divider, a voltage controlled oscillator having one input connected to the output of each said phase detector, a synthesizer for each detector and having an input, means connecting the input of each synthesizer to the output of the respective voltage controlled oscillator, each synthesizer having a plurality of outputs at respective frequencies, means connecting one of the outputs of each synthesizer to the other input of the respective phase detector, and means for connecting the outputs of said synthesizers in selected groupings thereof to said keyers for the supply of tone signals thereto, each said variable frequency divider means comprising counter means having outputs at which binary signals are developed, decoder means connected to the outputs of said counter means and having outputs at which signals are developed which conform to the count in said counter means, means for withdrawing a selected output signal from said decoder means, and means for setting said counter means to zero when the count therein conforms to selected output signal.

5. An electronic organ according to claim 4 which includes a frequency divider having an output connected to said one input of each said phase detector and having an input connected to said one output of the respective synthesizer, said frequency divider squaring the signal from said one output.

6. An electronic organ according to claim 4 which includes switch means adjustably connectable to the outputs of each said decoder means, gate means supplied by each said switch means, a monostable multivibrator connected to each gate means and pulsed thereby on the count conforming to the adjustment of the respective switch means, said means for setting each counter means to zero being responsive to the output pulse from the respective monostable multivibrator.

7. An electronic organ according to claim 4 which includes a pair of two input first gates for each decoder means and means connecting the inputs of the first gates to selected outputs of said decoder means, two groups of two input second gates, one input of each second gate of each said group being connected to the output of a respective one of said first gates, means connecting the other inputs of said second gates to respective outputs of said decoder means, two input third gates each having one input connected to the output of a respective second gate, the other input of each said third gate adapted for being supplied with an enabling signal, a monostable multivibrator having an input connected to the outputs of said third gates, and means connecting the output of said monostable multivibrator to the respective counter means for resetting thereof when the monostable multivibrator is pulsed by an output from said third gates.

8. An electronic organ according to claim 7 in which said decoder means includes an integer decoder and a tens decoder and a hundreds decoder, one input of each first gate being connected to an output of the hundreds decoder and the other input to an output of the tens decoder, said one inputs of the second gates being connected to respective ones of the integer decoder outputs.

9. An electronic organ according to claim 7 in which said other inputs of said third gates are adapted to be supplied with an enabling signal sequentially and at a predetermined frequency.

10. In an electronic organ having playing keys and keyers actuated by the keys, electroacoustic means connected to receive tone signals from the keyers, and means for generating tone signals for suppling to the keyers; said means comprising a stable high frequency oscillator, a plurality of variable frequency divider means having an input connected to said oscillator, a phase detector for each divider means having one input connected to the output of the respective divider means, a voltage controlled oscillator connected to the output of each phase detector, a synthesizer having an input connected to the output of each voltage controlled oscillator and each having a plurality of outputs at respective frequencies, means connecting an output of each synthesizer to the other input of the respective phase detector, means for adjusting said divider means to predetermined respective division ratios, and circuit means including signal mixing means connecting the outputs of said synthesizers to said keyers to supply tone signals thereto.

11. An electronic organ according to claim 10 in which said circuit means includes frequency dividers to provide octavely related tone signals from each synthesizer output.

12. The method of generating at least one desired range of tone signals which have respective frequencies differing fractionally from the frequencies of respective ones of a selected range of musical tone signals which comprises; supplying a stable high frequency which is equal to the frequency of the highest tone of said selected range of musical tone signals multiplied by a large first number, dividing the thus supplied high frequency by at least one second number differing from said first number by a fractional part of the first number and supplying a thus derived divided down frequency to one input of a phase lock loop, synthesizing said desired range of frequencies from the output of the phase lock loop, and connecting one of the synthesized frequencies to the other input of the phase lock loop.

13. The method according to claim 12 which includes dividing the frequency of the said one synthesized frequency by two prior to the supply thereof to said other input of the phase lock loop.

14. The method according to claim 12 which includes mixing the reference frequencies with the synthesized frequencies prior to the supply thereof to at least some of the keyers.

15. The method according to claim 12 in which said second number is fractionallly smaller than said first number to produce a range of frequencies which are sharp relative to the selected range of musical tones.

16. The method according to claim 12 in which said second number is fractionally larger than said first number to produce a range of frequencies which are flat relative to the selected range of musical tones.

17. The method according to claim 12 which includes dividing the stable high frequency by a plurality of second numbers each differing from said first number in a respective direction and by a respective amount to produce ranges of frequencies which are respectively sharp and flat relative to the selected range of musical tones.

18. The method according to claim 13 which includes dividing the synthesized frequencies to provide a plurality of octavely related frequencies for each synthesized frequency.

* * * * *

UNITED STATES PATENT AND TRADEMARK OFFICE

CERTIFICATE OF CORRECTION

PATENT NO. : 4,063,484

DATED : December 20, 1977

INVENTOR(S) : John William Robinson

It is certified that error appears in the above-identified patent and that said Letters Patent are hereby corrected as shown below:

Col. 2, line 17, "be" omitted between "will" and "slightly"

Col. 2, line 27, "to" should be -- and --

Col. 3, line 45, "of"should be -- for --

Col. 4, line 41, second "and" should be deleted

Col. 5, line 13, "112" omitted between "terminal" and "thereof"

Claim 4, Col. 6, line 5, "varible" should be -- variable --

Claim 10, Col. 7, line 10, "suppling" should be -- supplying --

Claim 10, Col. 7, line 13, "each" omitted between "means" and "having"

Signed and Sealed this

*Ninth* Day of *May 1978*

[SEAL]

*Attest:*

RUTH C. MASON
*Attesting Officer*

LUTRELLE F. PARKER
*Acting Commissioner of Patents and Trademarks*